US010711483B2

(12) United States Patent
Moon

(10) Patent No.: US 10,711,483 B2
(45) Date of Patent: Jul. 14, 2020

(54) COLLAPSIBLE CHANGING TENT ASSEMBLY

(71) Applicant: Kristen Moon, Bel Air, MD (US)

(72) Inventor: Kristen Moon, Bel Air, MD (US)

( * ) Notice: Subject to any disclaimer, the term of this patent is extended or adjusted under 35 U.S.C. 154(b) by 0 days.

(21) Appl. No.: 16/266,558

(22) Filed: Feb. 4, 2019

(65) Prior Publication Data

US 2020/0018089 A1 Jan. 16, 2020

Related U.S. Application Data

(60) Provisional application No. 62/697,516, filed on Jul. 13, 2018.

(51) Int. Cl.

| | |
|---|---|
| ***E04H 15/00*** | (2006.01) |
| ***E04H 15/40*** | (2006.01) |
| ***E04H 1/12*** | (2006.01) |
| ***E04H 15/48*** | (2006.01) |
| *E04H 15/54* | (2006.01) |

(52) U.S. Cl.

CPC ..... *E04H 15/003* (2013.01); *E04H 1/1244* (2013.01); *E04H 15/405* (2013.01); *E04H 15/48* (2013.01); *E04H 15/54* (2013.01)

(58) Field of Classification Search

CPC ..... E04H 15/003; E04H 15/006; E04H 15/40; E04H 15/405; E04H 15/48; E04H 1/1244

See application file for complete search history.

(56) References Cited

U.S. PATENT DOCUMENTS

| | | | | | |
|---|---|---|---|---|---|
| 1,599,798 | A * | 9/1926 | Stockton | E04H 1/1244 | 2/89 |
| 1,803,626 | A * | 5/1931 | Lasley | E04H 1/1244 | 135/128 |
| 1,804,190 | A * | 5/1931 | Wendel | E04H 1/1244 | 2/89 |
| 2,150,620 | A * | 3/1939 | Frost | A45C 11/02 | 220/9.2 |
| 4,157,801 | A * | 6/1979 | Elmer | B65B 67/12 | 248/101 |

(Continued)

FOREIGN PATENT DOCUMENTS

| | | | | |
|---|---|---|---|---|
| DE | 29720298 U1 * | 7/1998 | ..... | E04H 15/003 |
| FR | 2635136 A3 * | 2/1990 | ..... | E04H 15/003 |

OTHER PUBLICATIONS

English translation of DE 29720298 U1 from espacenet.com.*

*Primary Examiner* — David R Dunn
*Assistant Examiner* — Danielle Jackson
(74) *Attorney, Agent, or Firm* — Boudwin Intellectual Property; Daniel Boudwin

(57) ABSTRACT

A portable changing tent made of flexible fabric construction affixed to a folding frame structure designed for easy portability and storage. The folding frame structure includes a plurality of flexible metal coils that are designed to be movable between an expanded configuration and a collapsed configuration. In the expanded configuration, the frame defines a conical housing having an interior volume that can be accessed via a closure flap or other door opening disposed on the flexible fabric material. The flexible fabric material can include additional openings that allow a parent or guardian to assist a child when changing within the conical housing. When in the collapsed configuration, the portable changing tent can be stored in a carrying bag for easy and compact storage.

15 Claims, 4 Drawing Sheets

(56) References Cited

U.S. PATENT DOCUMENTS 4,569,362 A * 2/1986 Fidler, Jr. ..... E04H 15/40 135/126
4,979,242 A 12/1990 Maggio
5,393,023 A * 2/1995 Callan ..... B65B 67/1205 248/150
5,528,849 A * 6/1996 Plinta ..... A01M 31/025 135/126
5,592,961 A * 1/1997 Chin ..... E04H 1/1244 135/117
6,431,393 B1 * 8/2002 Stewart ..... B65D 33/02 220/213
6,467,735 B1 * 10/2002 Clinton ..... B65B 67/12 248/153
7,815,372 B2 * 10/2010 Stanton ..... B65F 1/0006 220/9.3
7,849,866 B1 * 12/2010 Mangum ..... A47K 11/04 135/117
8,915,258 B1 * 12/2014 Beam ..... E04H 15/001 135/117
9,758,986 B1 * 9/2017 Moore ..... E04H 15/44
9,784,008 B1 10/2017 Carolina
9,932,752 B1 * 4/2018 Vila ..... A45F 3/02
10,113,328 B1 * 10/2018 Polisar ..... E04H 15/48
2006/0143773 A1 7/2006 Danilova
2006/0283493 A1 12/2006 Charles
2011/0203189 A1 8/2011 Moran
2012/0060881 A1 * 3/2012 Ly-Cho ..... E04H 1/1244 135/121
2013/0340159 A1 * 12/2013 Barrett ..... A47K 3/325 4/599
2015/0047118 A1 * 2/2015 Bilyk, Jr. ..... A47K 3/325 4/608

* cited by examiner

COLLAPSIBLE CHANGING TENT ASSEMBLY

CROSS REFERENCE TO RELATED APPLICATIONS

This application claims the benefit of U.S. Provisional Application No. 62/697,516 filed on Jul. 13, 2018. The above identified patent application is herein incorporated by reference in its entirety to provide continuity of disclosure.

BACKGROUND OF THE INVENTION

The present invention relates to portable changing tents. More specifically, the present invention provides a portable changing tent including a conical housing and one or more side panels that allow a parent or guardian to access the interior of the tent to assist a child changing therein. The portable changing tent is comprised of a first circular ring and a smaller second circular ring Many young children need to change clothing into or out of swimwear at public locations such as a beach, lake or public pool. Sometimes these locations do not offer a public restroom or changing area, or sometime the area is too far away or not immediately accessible in an emergency. Without a convenient location to change clothing, children may be exposed to the public when changing between swimwear and regular clothing, which can be embarrassing for the children. Parents often fumble with a towel in an attempt to try and cover their child while also trying to help them remove their swimsuit and put on dry clothing. Travelling to a bathroom or changing room is often inconvenient and sometimes unsanitary. Without a proper place to change, children may often have to travel home in a wet or sandy suit in their car seat. This can cause irritation for the child and a messy situation for the parent to have to clean up. A device that is configured to enable a child to conveniently change their clothing in he privacy when on the beach or other location is desired. Therefore, there is a need in the prior art for a convenient means for providing additional support surfaces for decks, balconies, beaches, waterfronts and public pools.

Devices have been disclosed in the known art that relate to portable changing tents. These include devices that have been patented and published in patent application publications. These devices generally relate to changing tents with collapsible frames that fold in an accordion fashion. These devices, however, fail to disclose a portable changing tent including a conical housing and one or more side panels that allow a parent or guardian to access the interior of the tent to assist a child changing therein.

In light of the devices disclosed in the known art, it is submitted that the present invention substantially diverges in design elements from the known art and consequently it is clear that there is a need in the art for an improvement to existing portable changing devices. In this regard the instant invention substantially fulfills these needs.

SUMMARY OF THE INVENTION

In view of the foregoing disadvantages inherent in the known types of collapsible changing tents now present in the known art, the present invention provides a portable, collapsible changing tent wherein the same can be utilized for providing convenience for the user when assisting a child attempting to change within the interior of the device.

It is therefore an object of the present invention to provide a new and improved collapsible changing tent assembly that has all of the advantages of the known art and none of the disadvantages.

The present system comprises a first circular ring constituting a base and a second smaller circular ring constituting the top of the structure connected to each other through perpendicular supporting rods and covered with a fabric material defining an interior volume within the structure. An opening defined by overlapping flaps is disposed on the surface of the fabric material running longitudinally from the first circular ring towards the second circular ring wherein a user may selectively access the interior while remaining in a closed position otherwise through elastic bands on the end of the flaps for privacy.

It is another object of the present invention to provide a collapsible changing tent assembly wherein the supporting rods of the structure are made of a flexible metallic construction to allow for the device to be folded in upon itself by twisting the circular rings down towards each other.

Another object of the present invention is to provide a collapsible changing tent assembly wherein the covering fabric material is comprised of an opaque synthetic material such as Nylon to provide privacy as well as flexibility and durability.

Yet another object of the present invention is to provide a collapsible changing tent assembly wherein the structure is large enough for a young child to be able to move around comfortably within the structure while also allowing a parent or guardian without the structure to assist the child through the opening disposed on the fabric material.

Another object of the present invention is to provide a collapsible changing tent assembly wherein ventilation slots are disposed along the covering fabric material near the second circular ring, which acts as the top of the structure, so as to promote air flow and circulation within the enclosed volume of the erected structure.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
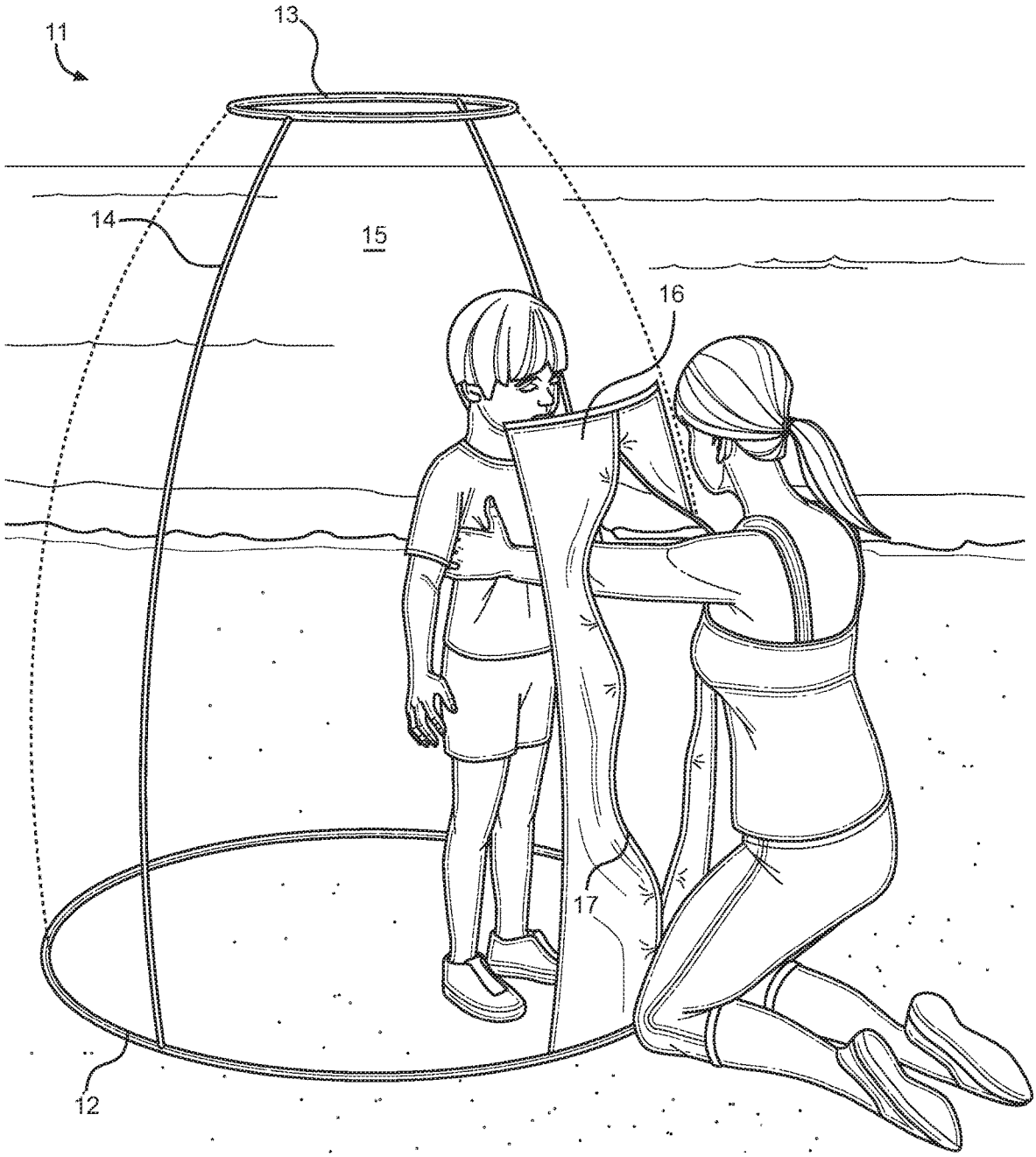
FIG. 1 shows a semi-transparent perspective view of an embodiment of the collapsible changing tent assembly in an expanded configuration showing the interior of the structure.

Reference is made herein to the attached drawings. Like reference numerals are used throughout the drawings to depict like or similar elements of the collapsible changing tent assembly. For the purposes of presenting a brief and clear description of the present invention, the preferred embodiment will be discussed as used for providing a shelter for changing children within an enclosed and private place. The figures are intended for representative purposes only and should not be considered to be limiting in any respect.

Figure 2:
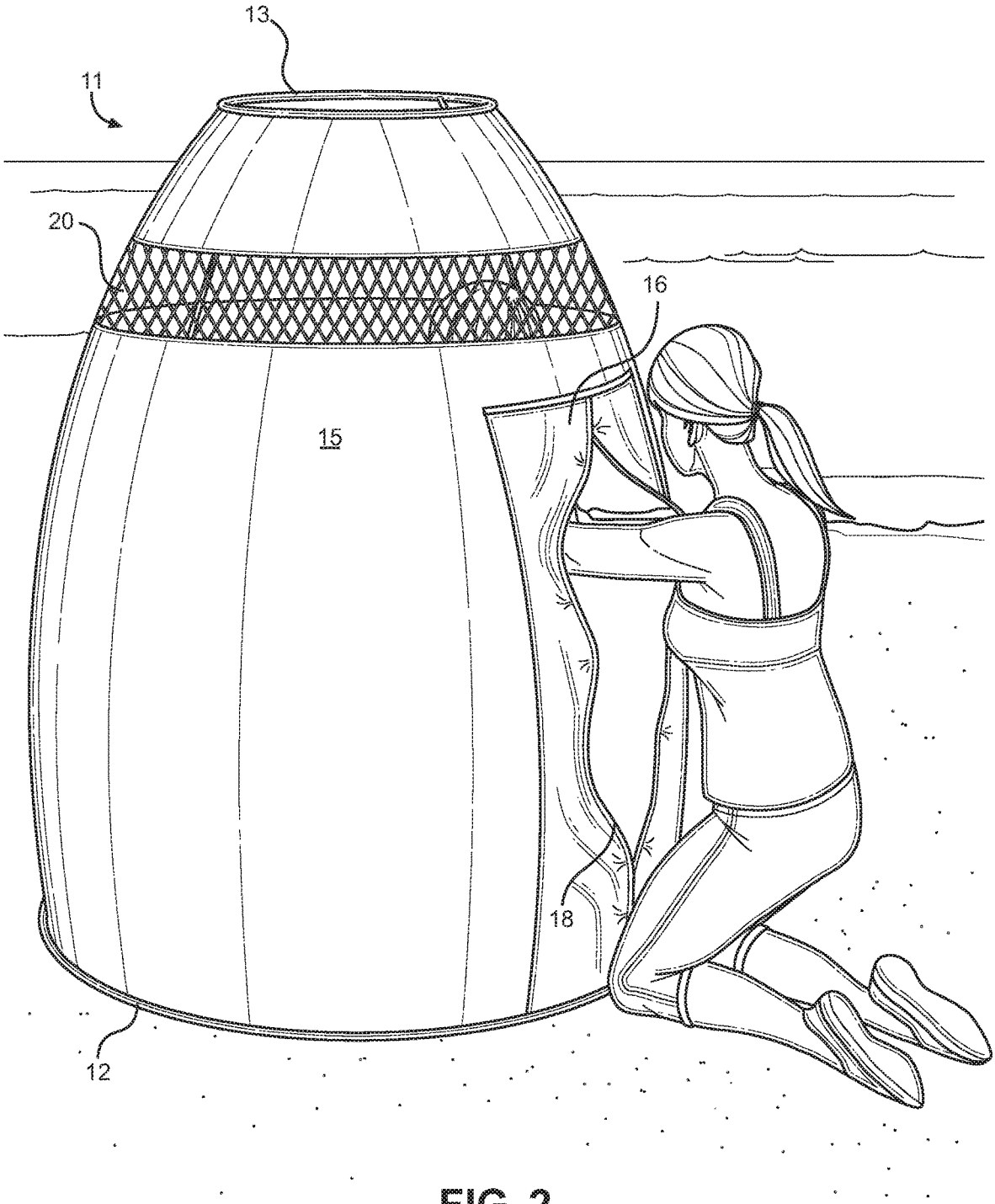
FIG. 2 shows a perspective view of an embodiment of the collapsible changing tent assembly in an expanded configuration with opaque covering fabric material.

Referring now to FIGS. 1 and 2, there is shown a semi-transparent perspective view of an embodiment of the collapsible changing tent assembly in an expanded configuration showing the interior of the structure and a perspective view of the collapsible changing tent assembly in an expanded configuration with opaque covering fabric material, respectively. The collapsible changing tent assembly 11 comprises a first circular ring 12 and a second circular ring 13 of a smaller diameter. Support rods 14 connect the first circular 12 ring on one end with the smaller second circular ring 13 on the distal end, creating the framework for the collapsible changing tent assembly 11. In the shown embodiment, the area within the first circular ring 12 is enclosed with fabric material. Further, in the shown embodiment, the area within the second circular ring 13 is unobstructed. A covering fabric material 15 is extended over this frame of the collapsible changing tent assembly 11 wherein the supporting rods 14 are received through channels in the fabric material 15 and attached around the rim of both circular rings 12 and 13 defining an interior volume.

The first circular ring 12 serves as a base for the structure and is designed to be placed on the ground, whereas the smaller second circular ring 13 forms the top of the structure. In some embodiments of the collapsible changing tent assembly 11, a system of fabric loops disposed around the perimeter of the first circular ring 12 allow for the device to be secured in position against the wind using stakes received therethrough to hold the base to the ground surface. The supporting rods 14 extend perpendicularly from the rim of the first circular ring 12 on one end through to the second circular ring 13 on the distal end. In one embodiment, a length of each of the supporting rods 14 is no longer than four feet in length. This forms a partially conical enclosure with the first circular ring 12 forming a wider base adapted to be placed on the ground for stability and slowly tapering toward the second circular ring 13, which forms the top of the collapsible changing tent assembly 11 structure, such that the structure will stand upright when assembled and placed level ground.

Figure 3:
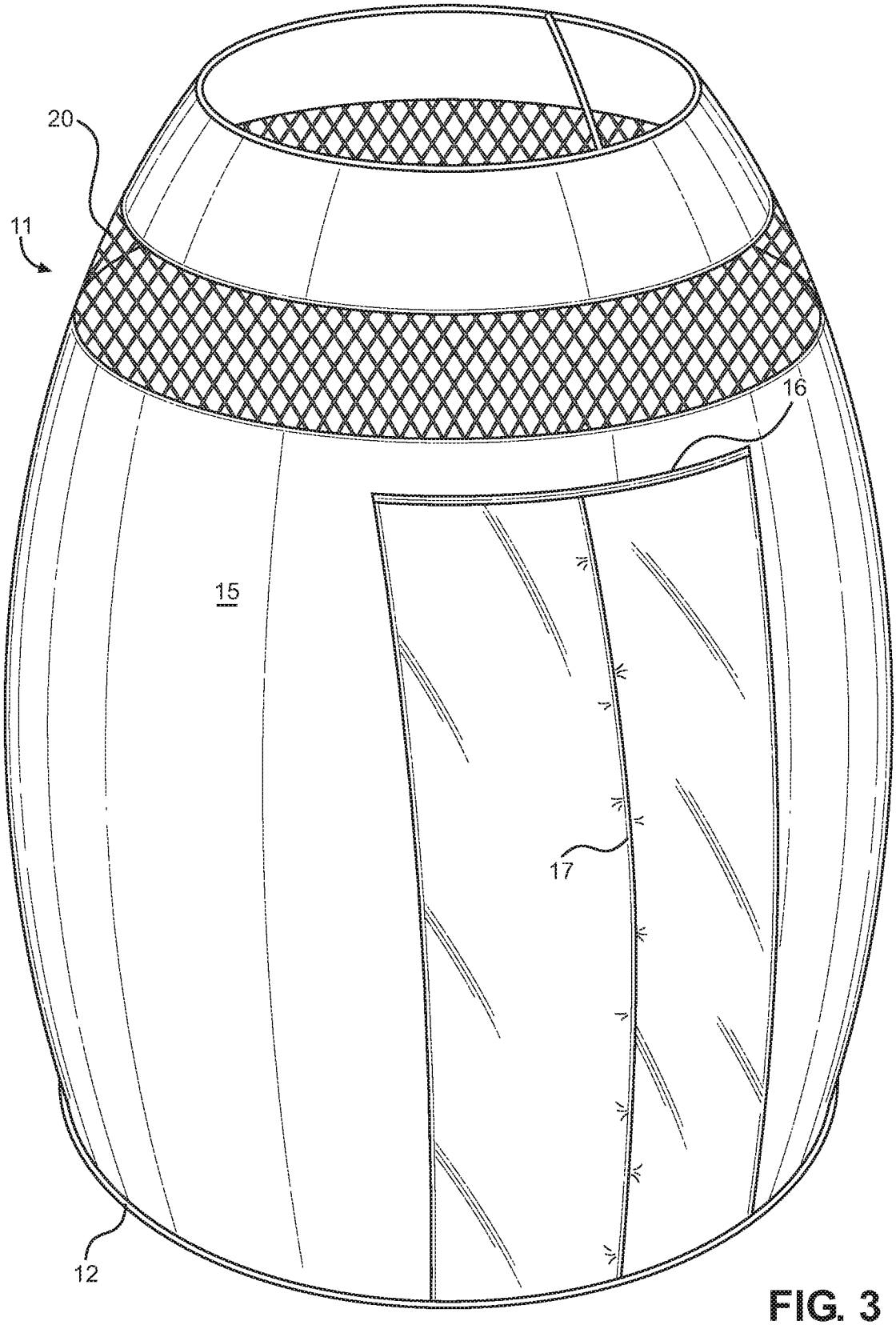
FIG. 3 shows a perspective view of an embodiment of the collapsible changing tent assembly showing the opening disposed on the surface of the device.

Referring now to FIG. 3, there is shown a perspective view of the collapsible changing tent assembly showing the opening disposed on the surface of the device. The collapsible changing tent assembly 11 includes an opening 16 disposed in the covering fabric material 15 to allow for a user to selectively access the interior volume of the device 11 structure. The opening 16 is comprised of overlapping flaps 17. In some embodiments, said flaps 17 include an elastic material disposed within distal ends thereof, such that the opening 16 remains closed for privacy when not being engaged by a user to either enter/exit the device, or when interacting with an occupant from without. In the illustrated embodiment, the flaps further comprise a fastener thereon, such as a hook and look fastener assembly, wherein the fastener is configured to retain the flaps in a closed position. In the illustrated embodiment, the opening 16 allows a child to enter the interior volume of the device 11 while also allowing a parent or guardian to interact with a child from the outside of the collapsible changing tent assembly 11. In an alternate embodiment, ventilation slots 20 comprised of interlaced mesh are included in the covering fabric material 15 near the top of the structure around the second circular ring 13 to allow for increased airflow and circulation within the interior volume of the device 11. The covering fabric material 15 is preferably made of a flexible synthetic material, such as Nylon, but may be made of any suitable material of durable and flexible construction.

Figure 4:
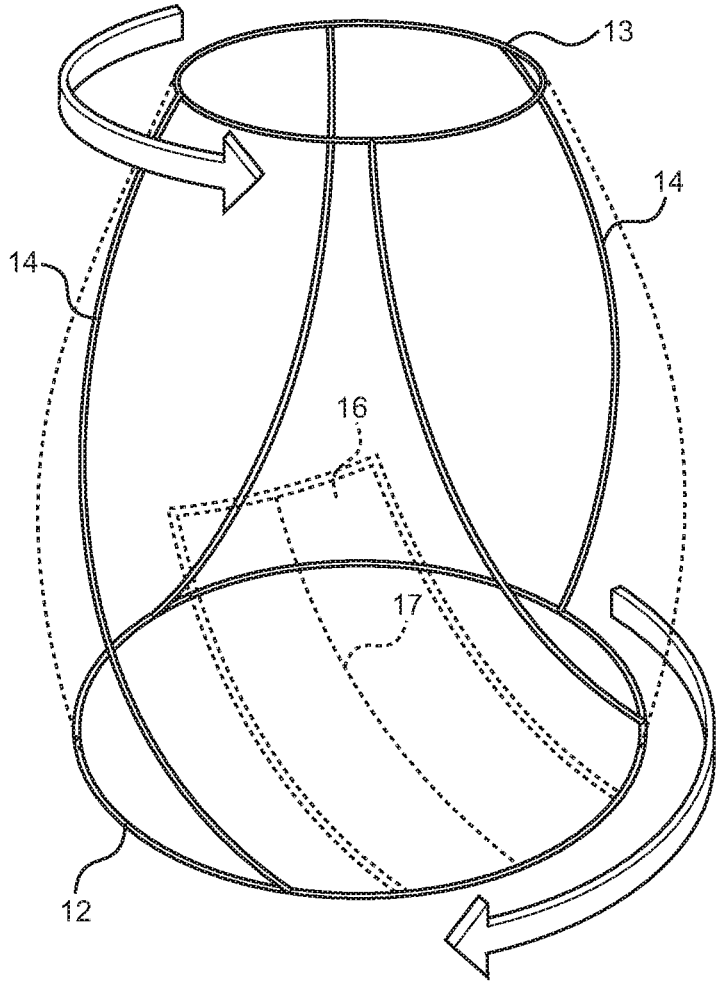
FIG. 4 shows a semi-transparent perspective view of an embodiment of the collapsible changing tent assembly being manipulated into a collapsed configuration.
Figure 5A:
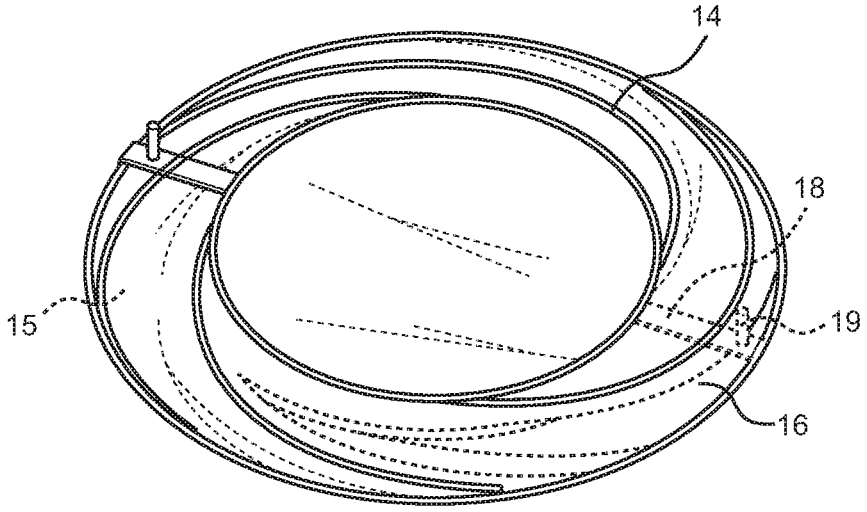
FIGS. 5A and 5B show a semi-transparent perspective view of an embodiment of the collapsible changing tent assembly being collapsed and in collapsed configuration for storage.
Figure 5B:
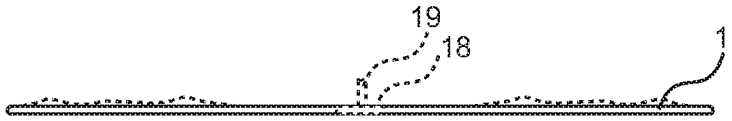

Referring now to FIGS. 4, 5A and 5B, there is shown a semi-transparent perspective view of an embodiment of the collapsible changing tent assembly being manipulated into a collapsed configuration and a semi-transparent perspective view of an embodiment of the collapsible changing tent assembly in a collapsed configuration for storage, respectively. The collapsible changing tent assembly 11 can define an expanded and a collapsed configuration. An expanded configuration is defined when the structure of the collapsible changing tent assembly 11 is such that an interior volume is defined between the first circular ring 12 and the second circular ring 13 being separated by the fully erect supporting rods 14 and enclosed by the covering fabric material 15. A collapsed configuration is defined when the device 11 is folded in upon itself for storage such that the first and second circular occupy the same plane when in a collapsed position.

To achieve a collapsed configuration, the flexible supporting rods 14 of the erect structure are folded so that the circular rings 12 and 13 are rotated in either a clockwise or counterclockwise fashion relative to each other. As the flexible supporting rods 14 are folded, the structure folds upon itself until the circular rings 12 and 13 are on a level plane with one another, the second circular ring 13 laying within the larger diameter of the first circular ring 12. The collapsed configuration can be maintained through a plurality of securable attachments 18 disposed on the fabric material 15 around the rim of the first circular ring 12. In the illustrative embodiment of the collapsible changing tent assembly 11, the securable attachments 18 comprise a length of fabric with a snap attachment 19 connected at the base of the first circular ring 12 adapted to wrapped around the second circular ring 13 and removably secure to a snap receiver close to the rim of the first circular ring 12. In other embodiments, the securable attachments 18 comprise a plurality of loop and toggle assemblies, hook and loop fasteners, or any other suitable means of securing the device in a collapsed position.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible changing tent assembly, comprising:

a first circular ring;

a second circular ring having a smaller diameter than the first circular ring;

a plurality of supporting rods of a flexible construction having a first end perpendicularly connected to the first circular ring and a second end perpendicularly connected to the second ring;

wherein the flexible construction of the supporting rods allows for the collapsible changing tent assembly to be folded flat such that the first and second circular rings occupy the same plane when the collapsible changing tent assembly is in a collapsed configuration;

a covering fabric material attached to the first circular ring and the second circular ring wherein channels within the flexible fabric material allow the supporting rods to pass through and define an interior volume between the circular rings;

a plurality of fasteners attached to the fabric material around the first circular ring;

wherein the plurality of fasteners is configured to secure the assembly in a collapsed position, the collapsed position defined by the first and second circular rings occupying the same plane;

an opening disposed on the fabric material wherein a pair of overlapping flaps affixed to the opening are configured to selectively move between an open position and a closed position, whereas an open position allows a user to selectively access the interior.

2. The collapsible changing tent assembly of claim 1, wherein the supporting rods are made of a flexible construction to allow for the second circular ring to be folded within a larger diameter of the first circular ring thereby enabling the device to be folded flat for storage.

3. The collapsible changing tent assembly of claim 1, wherein the plurality of supporting rods is comprised of a flexible metallic construction.

4. The collapsible changing tent assembly of claim 1, wherein the covering fabric material is comprised of an opaque material.

5. The collapsible changing tent assembly of claim 1, wherein a length of each of the supporting rods is no longer than 4 feet in length.

6. The collapsible changing tent assembly of claim 1, wherein the opening disposed on the fabric material starts at a perimeter of the first circular ring and runs towards the second circular ring.

7. The collapsible changing tent assembly of claim 1, wherein the fasteners are adapted to receive securing stakes therethrough.

8. The collapsible changing tent assembly of claim 1, wherein the flaps of the opening disposed on the covering fabric material have an elastic end, wherein the elastic end is configured to spring-bias the flaps in the closed position.

9. The collapsible changing tent assembly of claim 1, wherein ventilation slots are disposed along the covering fabric material around the second circular ring in order to promote air flow circulation.

10. The collapsible changing tent assembly of claim 1, wherein each flap further comprises a fastener thereon configured to secure the flaps in a closed position.

11. The collapsible changing tent assembly of claim 1, wherein the area within the second circular ring is unobstructed.

12. The collapsible changing tent assembly of claim 1, wherein the area within the first circular ring is enclosed with fabric material.

13. The collapsible changing tent assembly of claim 1, wherein a plurality of loopholes around the perimeter of the first circular ring allow fasteners to secure the tent to the ground.

14. The collapsible changing tent assembly of claim 1, wherein mesh ventilation slots are disposed on the covering fabric material.

15. A collapsible changing tent assembly, comprising:

a first circular ring;

a second circular ring having a smaller diameter than the first circular ring;

a plurality of supporting rods of a flexible construction having a first end perpendicularly connected to the first circular ring and a second end perpendicularly connected to the second ring;

wherein the flexible construction of the supporting rods allows for the collapsible changing tent assembly to be folded flat such that the first and second circular rings occupy the same plane when the collapsible changing tent assembly is in a collapsed configuration;

a covering fabric material attached to the first circular ring and the second circular ring wherein channels within the flexible fabric material allow the supporting rods to pass through and define an interior volume between the circular rings;

a plurality of fasteners attached to the fabric material around the first circular ring;

wherein the fasteners are adapted to receive securing stakes therethrough;

wherein the plurality of fasteners is configured to secure the assembly in a collapsed position, the collapsed position defined by the first and second circular rings occupying the same plane;

an opening disposed on the fabric material wherein a pair of overlapping flaps affixed to the opening are configured to selectively move between an open position and a closed position, whereas an open position allows a user to selectively access the interior.

* * * * *